United States Patent [19]

Ferguson

[11] Patent Number: 4,964,556

[45] Date of Patent: Oct. 23, 1990

[54] FORMS FEED TRACTOR WITH LID WHICH FACILITATES FORMS ALIGNMENT

[75] Inventor: Gregory A. Ferguson, New Bedford, Mass.

[73] Assignee: Precision Handling Devices, Inc., Fall River, Mass.

[21] Appl. No.: 407,004

[22] Filed: Sep. 14, 1989

[51] Int. Cl.[5] ..... B65H 20/20

[52] U.S. Cl. ..... 226/74; 400/616.1

[58] Field of Search ..... 400/706, 709.2, 616.1, 400/616.2; 226/74, 75; 33/623, 645, 533

[56] References Cited

U.S. PATENT DOCUMENTS

| | | | |
|---|---|---|---|
| 2,662,629 | 12/1953 | Moshier et al. | 400/709.2 X |
| 2,960,776 | 11/1960 | Cannata | 33/533 X |
| 4,285,604 | 12/1981 | Rex | 400/247 |
| 4,332,089 | 6/1982 | Denning | 33/623 |
| 4,345,708 | 8/1982 | Hubbard | 226/74 |
| 4,498,245 | 2/1985 | Mayor | 33/533 X |

*Primary Examiner*—Stanley N. Gilreath
*Assistant Examiner*—Paul Thomas Bowen
*Attorney, Agent, or Firm*—Martin LuKacher

[57] ABSTRACT

An improved lid for a forms feed tractor, which feeds successive interconnected sheets of paper having edge perforations (feedholes), the sheets having forms printed thereon or being blank, in printers, copiers and the like is provided with an improved lid mechanism having an extension outboard of the tractor and over the form. A transparent or translucent window section in this extension is provided with markings which are seen when the lid is pivoted down and closed so as to capture the form. Then the form can be moved so that the edge of each sheet or certain markings on the form are in proper alignment in the printer or copier. Then when printing occurs or when copying onto the form occurs, the printing will be located in line with other material on the form or properly spaced from the top edge of each sheet.

12 Claims, 5 Drawing Sheets

FORMS FEED TRACTOR WITH LID WHICH FACILITATES FORMS ALIGNMENT

DESCRIPTION

The present invention relates to tractors which feed paper, such as may have forms printed thereon, through printers, copiers and the like; the tractors having endless belts with pins engageable with the paper in perforations therein in order to feed the paper through the printer or copier.

The invention is especially suitable for use in a tractor which feeds continuous, pre-printed forms (e.g., bank checks, shop orders, purchase orders and the like) through a printer, and where it is desirable to prevent misalignment of the preprinted forms with the print elements (for example, the print head or band) of the printer so that printing occurs in alignment with printed matter, such as lettering or boxes, on the form. The invention is also useful wherever it is desired to locate in certain parts of the form, for example, the top edge so that the printing can be located within a space (the sight) a predetermined distance below the top edge or between the top and bottom edges of the sheet.

Tractor feeds have a pair of tractors which are mounted on drive and support shafts and are spaced apart on these shafts so as to receive the perforated paper and locate the pins which project from the tractor belt in the perforations of the paper. Such tractors and tractor feeds are shown for example in Hubbard, U.S. Pat. No. 3,825,162 issued July 23, 1974; Hubbard, U.S. Pat. No. 4,129,239 issued Dec. 12, 1978 and Hubbard, U.S. Pat. No. 4,345,708 issued Aug. 24, 1982. In aligning the form, for example with the printhead of a printer, notches or arrows may be marked on the cover or lid of the tractor. The location of the paper with respect to these notches or arrows is difficult to view due to parallax. Then, when the paper is moved either by hand or by turning the tractor drive shaft manually or with the motor drive, the paper, and particularly the material on preprinted forms, is still misaligned with the printing mechanism and the printer does not function as required to print in the desired spaces or boxes on the form.

It has been found in accordance with the invention that accuracy of alignment depends upon close proximity between the form and any alignment marks on the tractor. It has also been discovered that during alignment, when the form is moved, to locate it and align it with other parts of the printer, the cover or lid of the tractor must be maintained closed, in position where it captures the form and controls the path of travel of the form.

It is the principal object of this invention to provide a forms feed tractor with an improved lid structure having a window which presents indicia in close proximity to the form so as to enable alignment of the form, when the form is captured in the tractor between the tractor frame and belt on one side and the tractor lid on the other side of the form.

It is another object of the present invention to provide an improved lid structure with windows on which indicia are provided and which does not detract from the strength of the lid.

It is a still further object of the present invention to provide an improved lid structure for forms feed tractors with a window which also enables visual observation of the pins and the perforations in the form to check on their alignment when loading the form into the tractor.

Briefly described, the invention provides an improved lid structure for a perforated forms feed tractor having a frame, a sprocket rotatable in the frame and an endless belt with pins which project from a surface of the belt. The form is loaded on the belt with the pins thereon extending through the perforations in the form. The lid structure is pivotly mounted on the frame and is movable between open and closed positions away from the form and adjacent to form, respectively. The lid captures the form when it is in closed position. The lid has a section which provides a window through which the form is visible. Indicia are marked on the window. The window may be made of transparent or translucent material and the indicia located on the underside of the window section in close proximity to the form. There may be a plurality of lines which provides the indicia, each spaced from a central line and each of a progressively shorter length in a direction away from the center line. Then the amount of misalignment can be measured and the tractor driven by the drive motor or manually or the form can be manually grabbed and displaced with the belt to bring it in alignment with the marks and thereby aligning the form with the printing mechanism of a printer equipped with a tractor feed including the tractor having the window.

The foregoing and other objects, features and advantages of the invention as well as the presently preferred embodiment thereof will become more apparent from a reading of the following description in connection with the accompanying drawings in which.

Figure 7:
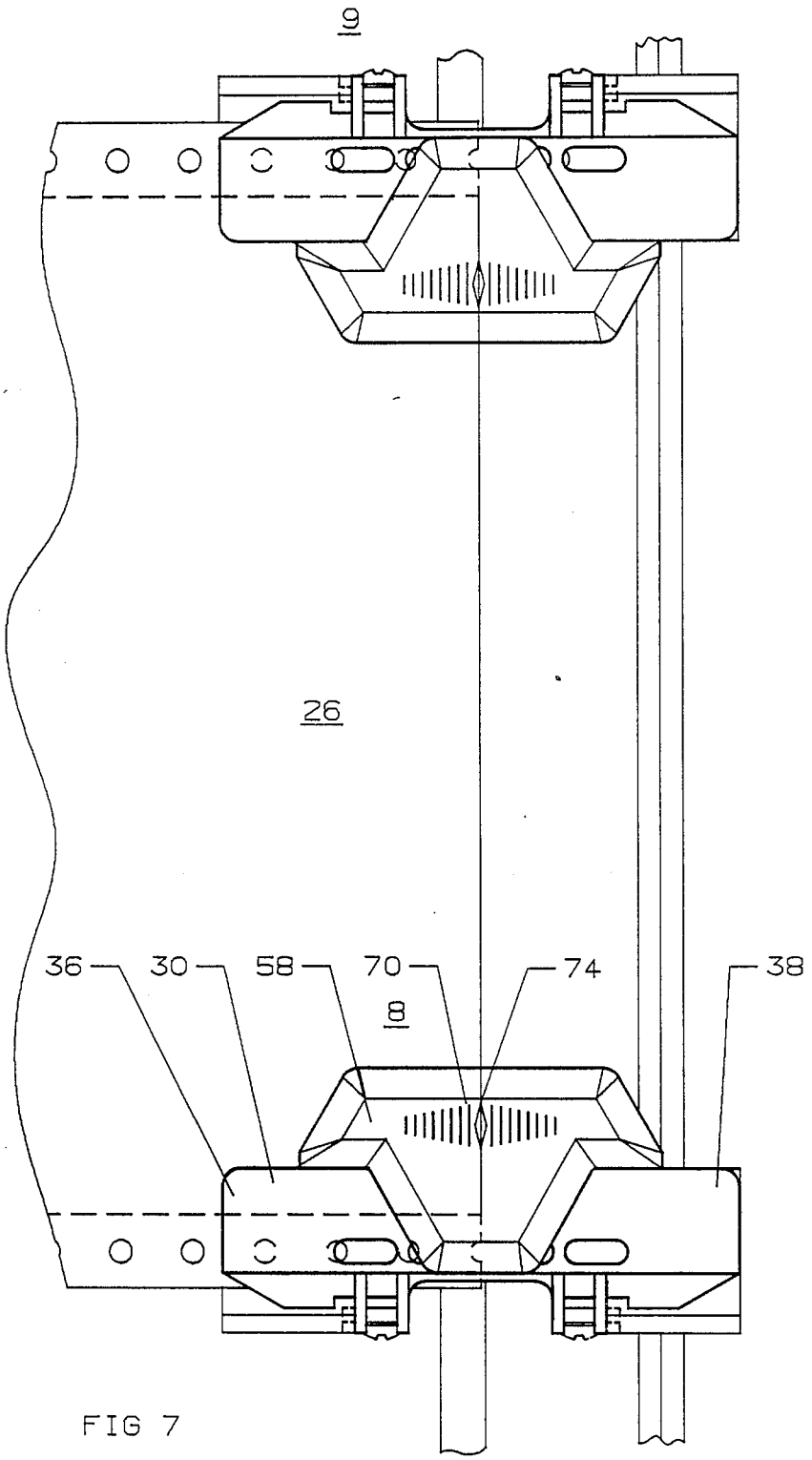
FIG. 7 is a fragmentary and diagrammatic top view showing the alignment of the top edge of a form with the center line of the alignment indicia shown in FIGS. 1, 4A and 4B.

Referring to the drawings, there is shown one of the tractors 8 of a tractor drive, the other tractor 9 of which is disposed on the opposite side of the form as viewed in FIG. 7. The tractors 8 and 9 may be alike, and one of them is described herein in detail. The tractor has a frame 10, an inside side plate 12 and an outside side plate 14, in which frame 10 a drive sprocket 16 and an idler sprocket 18 are journaled. A collet and ring clamping mechanism 20 of the type shown in the above referenced U.S. Pat. No. 4,129,239 is also mounted in the frame 10. An endless belt 22 is entrained around the sprockets 16 and 18 and presents a surface 24 on which the form or paper 26 is received and supported with pins 28 extending through perforations along the edges of the form 26.

The tractor has a lid 30 with an inside edge 32 and an outside edge 34. The width of the lid between the edges 32 and 34 and the length of the lid 30 between an upstream end 36 and a downstream end 38 (in the direction of travel of the form 26 as viewed in FIG. 7) is approximately the same as the top surface of the frame 10 so that the lid overlies the frame 10. The lid also has slots 52, 54 and 56 through which the pins 28 extend when the lid is in closed position.

The lid is pivotly mounted adjacent to the outside edge 34 on pins 40 and 42 which are received in notches in the outside side plate 14. The pins are biased by flat springs 44 and 46 against the side plate 14 and held by screws 48 and 50 on the side plate 14. This lid pivot enables the lid to be pivoted upwardly and then held in an open position shown at 51 in FIG. 2, so as to enable loading of the paper 26 in the tractor. The design of the lid with this pivot mechanism is the subject matter of U.S. patent application Ser. No. 328,424 filed Mar. 24, 1989 in the name of the inventor hereof, Gregory A. Ferguson, and assigned to be same assignee as this invention.

An extension 58 is attached to the lid, and has generally trapezoidal inside portion 60, the base 62 of which is disposed along the inside edge 32 of the lid 30. The extension 58 also has a outside trapezoidal portion 64, the base of which is common to the base 62 of the inside trapezoidal portion 60. The outside trapezoidal portion 60 has a window 66 of transparent or translucent material (transparent material being preferred). This material has indicia 70. The indicia consist of a center line 72 and two sets of lines each with a plurality of lines of length which decreases gradually with distance from the center line. The lines are at equally spaced increments. The center line 72 defines a diamond, the apexes 74 and 76 of which define the length of the center line 72.

All of the tractor parts may be of plastic material including the extension 58. The extension 58 may be entirely of translucent or transparent material and therefore defines a window in its entirety. However, the window 66 alone may be transparent or translucent and is preferrably made from a transparent polycarbonate plastic.

The indicia 70 are marked on the bottom surface of the window 66 so that they are in close proximity to the form 26. In addition sighting through the window at an oblique angle enables the observation of the pins and a visual check on whether they are aligned with the perforations in the form 26.

Figure 1:
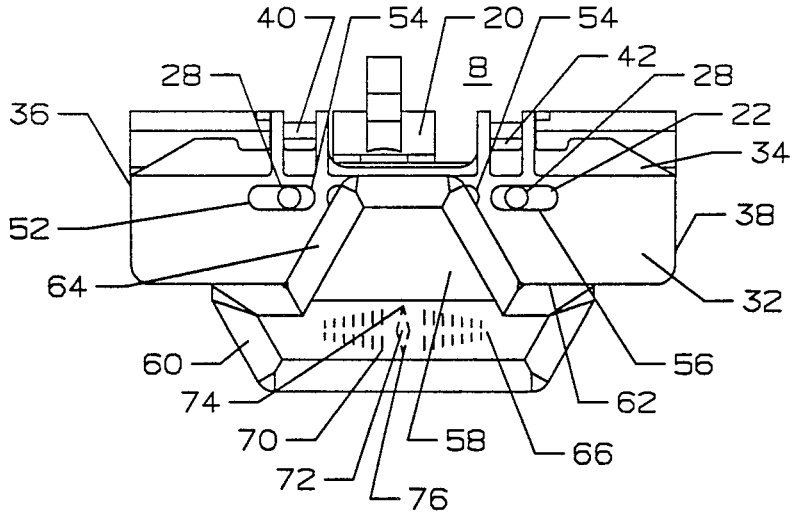
FIG. 1 is a plan view of a forms feed tractor embodying an improved lid structure in accordance with the invention.
Figure 2:
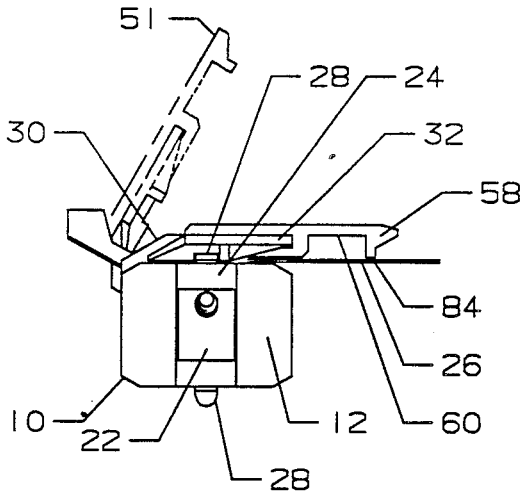
FIG. 2 is a left end view of the tractor shown in FIG. 1.
Figure 3:
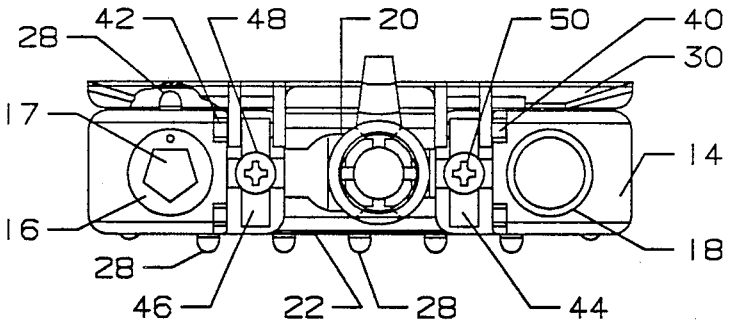
FIG. 3 is an elevational view from the back or outside of the tractor shown in FIGS. 1 and 2.
Figure 5A:
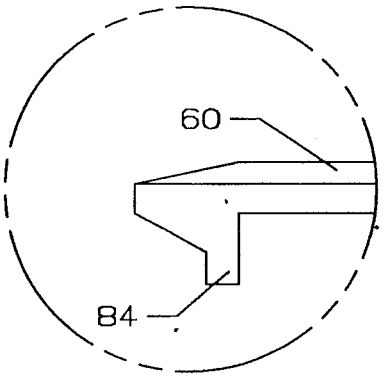
FIGS. 5A and 5B are enlarged fragmentary views of the front edge and rear edge portions of the extension shown in FIG. 5.
Figure 5B:
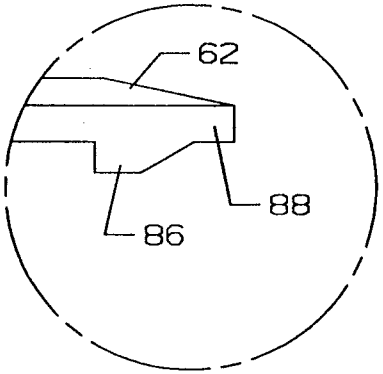
Figure 5:
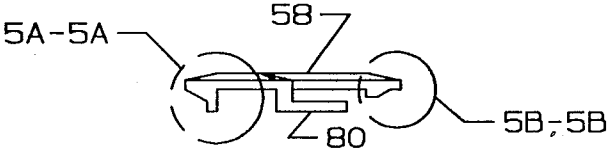
FIG. 5 is an end view from the right as viewed in FIG. 4A of the extension shown in FIGS. 4A and B.
Figure 4A:
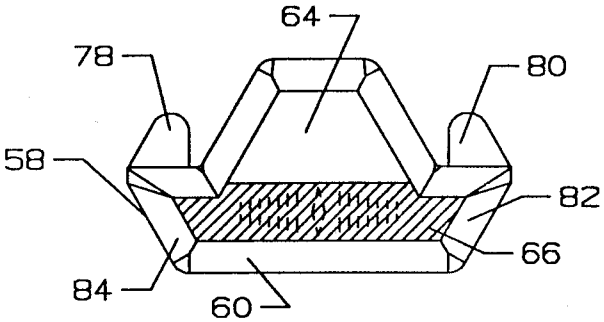
FIG. 4A is a top plan view of the extension having the transparent window which is shown in FIGS. 1 to 3.
Figure 6:
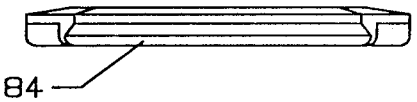
FIG. 6 is a front elevation of the extension shown in FIGS. 4A and B.
Figure 4B:
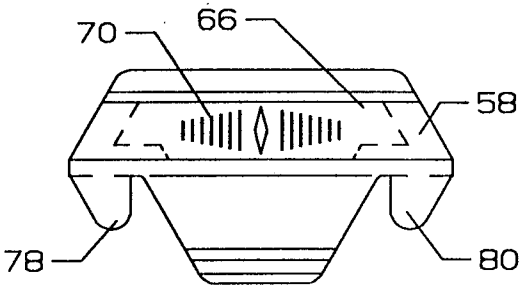
FIG. 4B is a bottom plan view of the extension shown in FIG. 4A.

It will be appreciated that the extension 58 and the lid 30 may be made in one piece rather than in two pieces (a bi-part lid) and assembled as shown in FIGS. 1 to 3. Assembly of the separate extension 58 is facilitated by feet 78 and 80 which extend from wings 82 and 84 in the regions at the ends of the inside trapezoidal section 60.

The inside trapezoidal section 60 and the window 66 extends inwardly beyond the frame 10 and beyond the inside edge 32 of the lid 30 as shown in FIG. 2. The window 66 therefore overlies the form 26 and is clear of the frame 10. A rib 84 extends in the direction of travel of the form (along the inside edge 32 of the lid) so as to guide the form as it travels through the tractor. The lid 30 may be pinched between the feet 78 and 80 and the outside section 62 of the extension 58 and held by friction fit. Preferable a lug 86 is formed near the outside edge 88 of the outside section 62 of the extension 58. This lug extends partially into the slot 54 with a snap fit (a detent action) to hold the extension 58 on the lid 30.

In operation, for aligning the top edge of the form 26 as shown in FIG. 7, the form may be moved by turning the drive shaft, which extends through the five sided hole 17 in the sprocket 16, until the top edge is in line with the center line 72 of indicia 70. Then, when printing occurs, the form will receive the printed material at a desired distance below the top edge of the form 26. There may be other alignment marks on the form which may be aligned with the center line or any of the other lines or with a plurality of these other lines in order to assure that printing occurs in the desired boxes or spaces on the form as the form is fed through a printer or copier.

From the foregoing description it will be apparent that there has been provided an improved forms feeding tractor having an improved lid mechanism which enables alignment of the form conveniently, precisely and accurately when the form is captured in the tractor. Variations and modifications of the herein described improved lid, within the scope of the invention, will undoubtedly suggest themselves to those skilled in the art. Accordingly the foregoing description should be taken as illustrative and not in a limiting sense.

I claim:

1. In a forms feed tractor having a frame, a sprocket rotatable in said frame and an endless belt having pins projecting from a surface thereof into a form for feeding said form, said belt being mounted in said frame entrained around and in driving relationship with said sprocket, said form being received on said belt surface with said pins extending through the perforations therein in feeding relationship with said belt, an improved lid pivotly mounted on said frame and movable between a first position adjacent to said surface and capturing said form when said form is disposed on said belt and a second position spaced away from said surface to enable said form to be loaded in said tractor on said belt with said pins in said perforations, said lid having a window through which said form is visible, indicia on said window disposed over said form when said lid is in said first position, said form being movable with said belt to locate said form with respect to said indicia thereby aligning said form in said tractor, said lid having a first portion overlapping said frame, said lid also having an inside edge and an outside edge, said lid being pivotly mounted adjacent to its said outside edge, an extension attached to said lid and extending inwardly from said inside edge overlapping said frame and extending outwardly beyond said inside edge of said lid, said window being disposed in said extension outwardly beyond said inside edge of said lid, whereby said window is located outwardly from said frame overlapping said form but not said frame.

2. The improvement according to claim 1 wherein said indicia include a plurality of lines which provide a measure of the displacement of a top edge of said form from a desired position.

3. The improvement according to claim 2 wherein said lines are is different length and change of length in a direction which is the same direction as that of a side edge of said form.

4. The improvement according to claim 3 wherein one of said lines is disposed centrally of said window and is of the longest length of said plurality of lines, and said plurality of lines includes a first and second set of lines each with a plurality of lines of progressively shorter length on opposite sides of said one of said lines.

5. The improvement according to claim 4 wherein said one of said lines defines a diamond shape having apexes, the distance between which defines the length of said one of said lines.

6. The improvement according to claim 1 wherein said window has a first surface on one side thereof in close proximity to said form and a second surface on the side thereof opposite to said one side first surface, said indicia being marked on said first surface of said window so as to be in close proximity to said form.

7. The improvement according to claim 1 wherein said extension has a first generally trapezoidal section with a base, said first section extending inwardly over said lid, said base being disposed along said inside edge of said lid, said extension having a second generally trapezoidal section with a base which is coincident with said base of said first section, said base of said first section being wider than the base of said second section so as to define wings extending on opposite sides of said first section, said window being provided in said second section.

8. The improvement according to claim 7 further comprising feet on said wings extending under said lid for locating said extension on said lid.

9. The improvement according to claim 7 further comprising a rib on said extension disposed outwardly of said window and presenting a surface disposed adjacent to said form.

10. The improvement according to claim 1 wherein said extension is an integral body of plastic material.

11. The improvement according to claim 10 wherein said body is molded of said plastic material with said window therein of different material which is transparent or translucent so as to make said indicia and said form visible through said extension.

12. The improvement according to claim 11 wherein said extension is removably attached to said lid.

* * * * *